United States Patent [19]

Marass

[11] 4,363,695

[45] Dec. 14, 1982

[54] AUTOMATIC REEL CHANGE SYSTEM

[75] Inventor: Josef Marass, Seehausen, Fed. Rep. of Germany

[73] Assignee: Georg Spiess GmbH, Gersthofen, Fed. Rep. of Germany

[21] Appl. No.: 209,071

[22] PCT Filed: Feb. 20, 1980

[86] PCT No.: PCT/DE80/00016

§ 371 Date: Oct. 21, 1980

§ 102(e) Date: Sep. 25, 1980

[87] PCT Pub. No.: WO80/01794

PCT Pub. Date: Sep. 4, 1980

[30] Foreign Application Priority Data

Feb. 21, 1979 [DE] Fed. Rep. of Germany ..... 2906598

[51] Int. Cl.[3] ..... B31F 5/06; B65H 19/18

[52] U.S. Cl. ..... 156/504; 156/505; 242/58.4; 242/58.5

[58] Field of Search ..... 156/159, 504, 505; 242/58.4, 58.5, 58.2, 58.1

[56] References Cited

U.S. PATENT DOCUMENTS

| | | | |
|---|---|---|---|
| 3,549,458 | 12/1970 | Osta | 156/505 |
| 3,717,057 | 2/1973 | Takimoto | 156/505 |
| 3,749,634 | 7/1973 | Krause | 156/505 |
| 3,939,031 | 2/1976 | Takimoto | 156/505 |
| 4,067,760 | 1/1978 | Nelson | 156/504 |

FOREIGN PATENT DOCUMENTS

| | | |
|---|---|---|
| 1123898 | 2/1962 | Fed. Rep. of Germany . |
| 1273950 | 7/1968 | Fed. Rep. of Germany . |
| 2272933 | 12/1975 | France . |
| 2349526 | 11/1977 | France . |

*Primary Examiner*—Michael G. Wityshyn
*Attorney, Agent, or Firm*—Allison C. Collard; Thomas M. Galgano

[57] ABSTRACT

For designing an automatic reel change system for use in connection with the processing of a web from a reel (7, 8) on a reel support (2), the web being sheeted in a transverse cutter (3), the invention takes the form of a system which makes do with a very narrow web part having a greater-than-normal thickness, but, nevertheless, safely joining the two webs together; the reel stand (or support) (2) has support parts (9 and 10) for at least two reels (7 and 8), from which, on reel change-over, a double web, made up of old web (11) (web coming to an end) and new web (12) (web from the new reel), may be taken, and near the path of the web, a cutting station (14) is present, able to be put into operation for cutting through the double web, a joining station (15), able to be put into operation the necessary time after operation of the cutting station (14), for joining the end (30), produced on cutting operation, of the old web (11) with the leading edge (31), produced on cutting operation, of the new web (12), using an adhesive strip (23) overlapping the ends as a join, an advancing unit (13) which is placed before said cutting station, said advancing unit (13) being designed for acting on the double web run through it and being put into operation at least between the cutting and joining operations, and near the joining station (15) for the new web (12) and old web (11), pulling parts (16), able to be put into operation separately, which are designed for taking effect on the front ends of the cut off runs, placed in front of and after the position of cutting, of the two webs in question.

8 Claims, 6 Drawing Figures

AUTOMATIC REEL CHANGE SYSTEM

Figure 1:
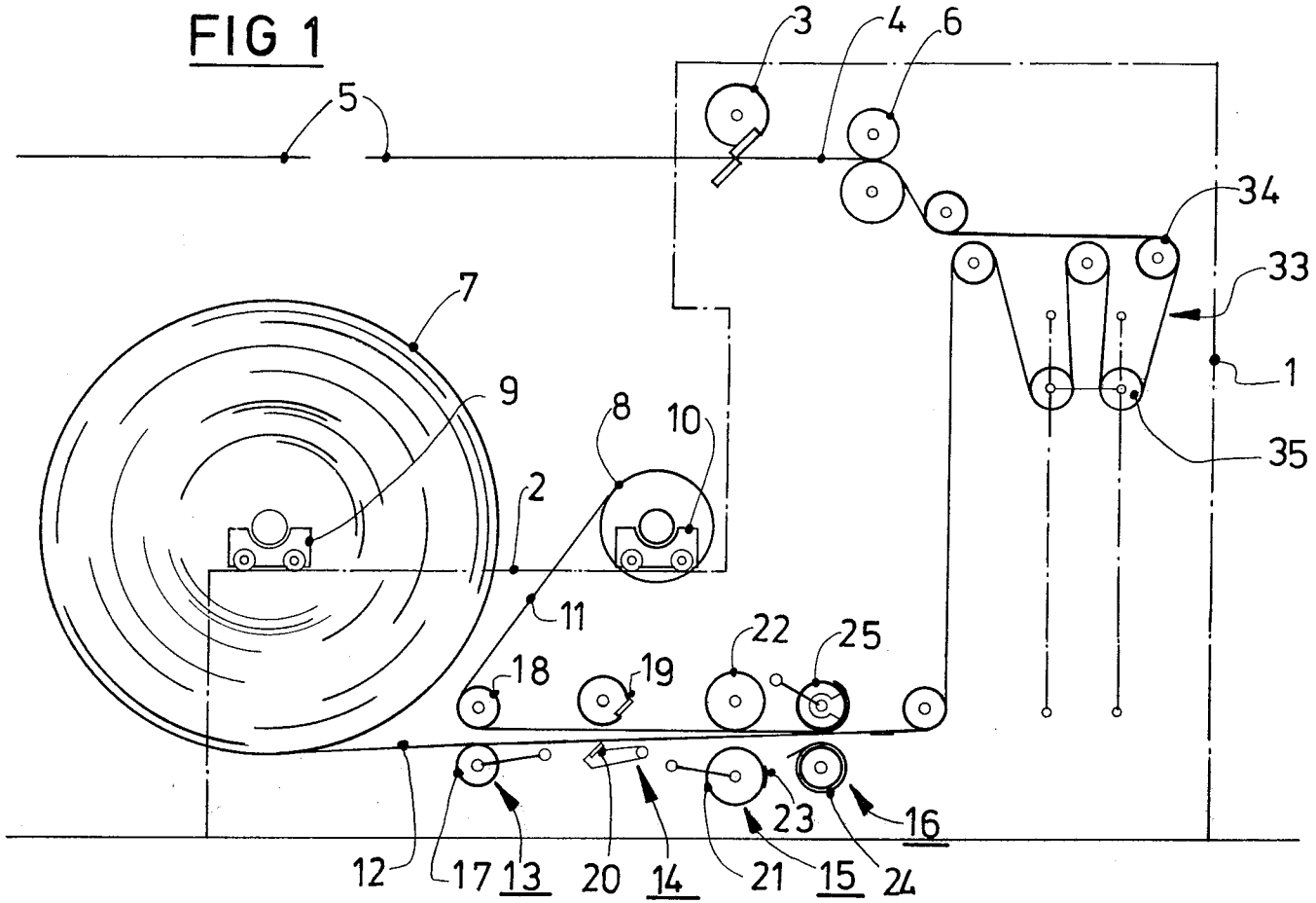

BACKGROUND OF THE INVENTION (i) Field to which the invention relates

The present invention is with respect to an automatic reel change system for use in connection with the processing of a web, coming from one reel in a reel support, the web being sheeted in a transverse cutter.

(ii) The prior art

German Pat. No. 2,010,467 has an account of a system for processing a web which is sheeted in a transverse cutter and is taken from a reel. In this prior art system, the reel support is only designed for one reel at a time. When the reel has run to an end, an new reel has to be placed in position and the web threaded in again, a complex and time-taking operation causing drop-outs in production and generally increasing the running costs of the plant.

In the web-feed, rotary press art automatic reel change makes continuous operation possible. In old systems of this sort (see for example German Offenlegungsschrift specifications Nos. 2,246,360 and 2,331,125) a "reel" (short for reel stand) is used for supporting a number of reels at the time and having a frame with a horizontal axle with spokes radiating from the hub near each end and horizontal bars or slats connecting these in pairs. When stock is running to an end on one reel, the next, new reel is speeded up to the running speed by a separate driving unit. For joining the web, which is coming to an end on the old reel to the next web, taken from the new reel, the old web is pressed against the new reel and joined to it by paste placed in the space between the webs or present on one of them. After joining the old web is cut out. In system of this sort, it will be seen that there is a generally long overlap, in which the web will have twice its normal thickness. In web-feed presses, such a thicker part of the web may be put up with, but this is not so with sheet-feed presses which are much more likely to be damaged. For this reason, the overlapped web part has to be taken out of the flow of stock through the system using parts for sensing its position; however, the flow of stock is then interrupted and, necessarily, production is stopped and has to be started again. This would seem to be the reason why, so far, sheet-feed machines using webs (that is to say having a sheeter-feeder) have not been designed for automatic reel change.

SHORT OUTLINE OF THE INVENTION

One purpose of the present invention is that of designing, for the first time, a system of the sort noted, which is not only simple in design, but furthermore makes certain of trouble-free operation and, at the same time, while making certain of a safe web join, is only responsible for a very narrow thickened part of the web.

For effecting this purpose in the present invention, the reel stand has supports for at least two reels, from which, on reel changing, a double web made up of old web (web coming to an end) and new web (web from the new reel) may be taken, and near the path of the web, a cutting station is present, able to be put into operation for cutting through the double web, a joining station, able to be put into operation the necessary time after operation of the cutting station, for joining the end, produced on a cutting operation, of the old web with the leading edge, produced on the cutting operation, of the new web, using an adhesive strip overlapping the ends as a joint, and an advancing unit is placed before the cutting station, said advancing unit being designed for the double web to be run through it and being put into operation at least between the cutting and joining operation, and in that furthermore, near the joining station for the new and old webs, pulling parts, able to be put into operation separately, are present, which are designed for taking effect on the front end of the cut off run, placed in front of and after the position of cutting, of the web in question.

Because, in this respect, the two webs are cut in common generally at the same point or position, the end edges are, with a useful effect, right up against each other so that the joint may simply be made by way of a narrow adhesive strip or the like so that there is the useful effect of only having a very narrow thickened web part. Even with the cut cutting the two webs, there is the useful effect of there being no stop in forward web motion, because the advancing unit, placed in front of the cutting station, makes certain of the desired forward and advancing motion till the sticking or joining operation takes place. The advancing unit may be simply made up of two guide rolls, able to be placed against each other and separated, of which one at least is turned with the desired web speed. In this case, active operation is produced simply by putting the two guide rolls together. The pulling parts are best placed after the joining station. This makes possible simple guiding of the web between the cutting and joining stations. The pulling part used for the old web, generally has the effect of a sort of switch (as in a railroad) guiding the cut off end of the old web away from the web, which is then going to the transverse cutter. This may be made possible specially simply by using a suction roll, which is best able to be turningly moved (that is to say its axis may be swung) as a pulling part. The pulling part for use with the new web is used for speeding up the new reel with the new web, and, for this purpose, is best designed as a simple roll-up (or winding-up) roll, which is best powered by way of a slipping clutch. The part of the new web, which is in front of the position of cutting, is automatically rolled up on this roll, this producing, in turn, the useful outcome that the said winding-up roll may be simply kept running, at the start of a joining operation, till the outer, useless stock on the new reel has been taken up on the winding-up roll, because such outer layers, for example, on a reel of paper will generally be so much dried out as to have poor printing properties. Furthermore, such outer layers will normally be damaged, this being a further reason for such stock being useless. The useful effects of the invention are, for this reason, more specially to be seen in the rationalization which becomes possible.

If the pulling parts are placed after the joining station, this, as noted earlier, producing useful effects on guiding the web, the pulling part for the new web is best speeded up, after a cut has been made, so as to be a little faster than the regular web speed so that the back end of the waste run of web, which has been pulled off therefrom, may be moved clear uncovering the joining position, between the old and new webs for putting the adhesive strip in position.

Usefully, the pulling part for the new web may be placed under the web path while the pulling part for the old web is placed over it so that the new web will be run under the old one and the new reel may, for this reason, be simply placed behind the old, run out reel.

In a further useful development of the invention, there is a web pulling-in unit for guiding new web from its inlet position into the system at least as far as its pulling part.

Further useful developments and forms of the general teaching of the invention will be seen from the account now to be given of one working example as based on the figures, in connection with the rest of the dependent claims.

LIST OF FIGURES

FIG. 1 is a diagrammatic view of an apparatus of the invention as part of a sheeter feeder for moving sheets to a sheet-feed unit of a sheet-feed press.

FIGS. *2a* to *2e* are views of different stages of operation of the apparatus of the invention in five different positions coming one after the other.

DETAILED ACCOUNT OF ONE WORKING EXAMPLE OF THE INVENTION

The sheeter feeder of FIG. 1 has a frame 1, which is only outlined in the figure and from the side may be seen to be generally L-like, its lower leg being designed as a reel support 2. The sheeter feeder of FIG. 1 is placed at an angle to the sheet-feed unit, not figured in detail here, of a sheet-feed press, which is supplied with sheets 5, cut down to the desired size, in a direction generally normal to the plane of the figure, this supply operation being undertaken by a transverse cutter, generally numbered 3 and acting on stock web 4, in the present case a paper web, which is reeled off from the reel, supported on reel support 2, the reel in the present case being a paper reel. The motion of the web to transverse cutter 3 is produced by two traction rolls 6. The size of the reel support 2 is such that an unused reel of the sort to be seen at 7 and a further reel, from which most of the web has been reeled off, as figured at 9, may be supported and taken up one after the other. For taking up reels 7 and 8 two takeup units, in the present case in the form of reel carriages 9 and 10 are used, able to be moved along a reel support 2. The reel carriages are able to be moved from the back position of reel carriage 9 into the front position of reel carriage 10. The carriages are moved in the opposite direction simply by taking off and changing round whichever reel carriage is, at the time, in front.

For getting the apparatus ready for a run, an unused reel of the sort to be seen at 7 is placed on the reel carriage in the back position. As soon as about two thirds of this reel have been used, it is moved into the position 8 in FIG. 1 to make room for a new, unused reel. The necessary pushing force may be produced by hand or by a motor. In the case of hand operation, the reel carriages 9 and 10 will have braking systems, which are put out of operation for moving the carriages. On change-over from the used-up reel 8 to the new unused reel 7, the webs being pulled therefrom, 11 and 12, are simply joined up. The system for undertaking such an automatic reel change operation is made up of four working stations, placed on the path of the web, that is to say cutting station, generally numbered 14, a joining station, generally numbered 15 and placed after the cutting station, together with an advancing unit, generally numbered 13, coming before the cutting station in the direction of web motion. Next to the joining station 15 there are furthermore two pulling parts, both numbered 16, one for use with each web.

The advancing unit 13 is made up, in the example of the invention figured, of a guide roll 17, which is able to be swung into different positions and to be moved up against a guide roll 18, which is stationarily bearinged. One or each of the guide rolls may be powered. In the working example figured, only the swinging guide roll 17 is power-turned for putting the advancing unit 13 into operation, by moving the power-turned guide roll 17 up against the stationarily bearinged guide roll 18. The cutting station 14 may, as in the working example pictured, simply be made up of a second transverse cutter with a turning knife 19 and a swinging or pivoting knife 20. The joining station 15 is made up, in the example figured, of a swingingly or pivotably supported joiner roll 21, which is placed parallel to the cut to be made by cutting station 14 and may be moved up against a stationarily bearinged opposite roll 22. On joiner roll 21 an adhesive strip 23, stretching over the full breadth of the web, may be fixed so that, when joiner roll 21 is moved up against opposite roll 22, the adhesive strip is rolled on to the web material running through between the said rolls. Joiner roll 21 is, for this reason, turned at a speed in line with the speed of advance of the web stock. The pulling parts 16 are each made up of separately turned winding-up rolls 24 and 25, whose operation will be made clear later on. In the working example pictured, the winding-up rolls 24 and 25 are placed after the joining station 15 to make certain that web guiding elements, which are not detailed here, may be placed between the cutting station 14 and the joining station 15. The winding-up rolls 24 and 25 generally have the function of a switch as in a railroad for clearing the one or the other part, whichever is not needed, of the double web, running through the system of the invention on reel change-over.

Figure 2:
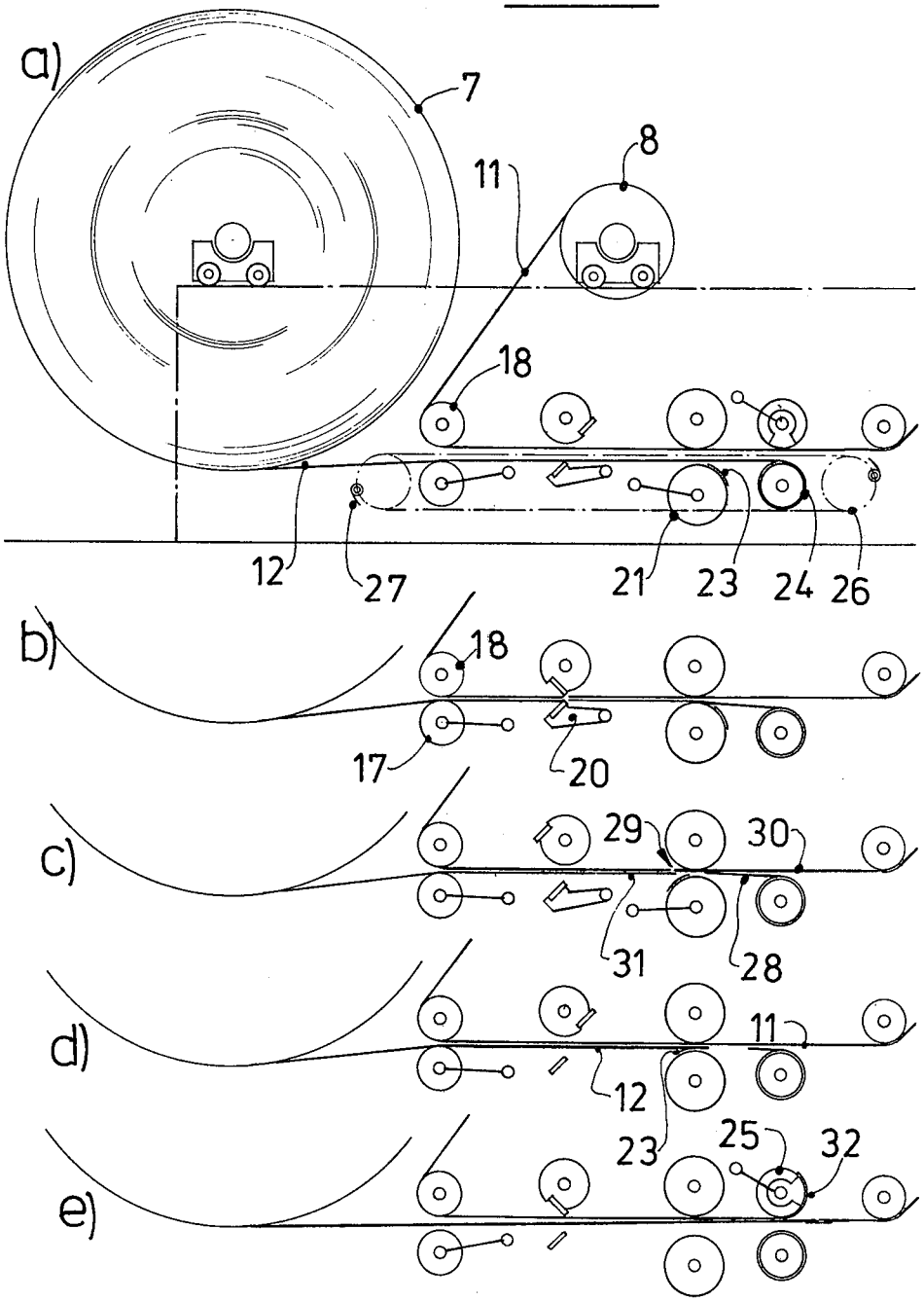
Figure 2A:
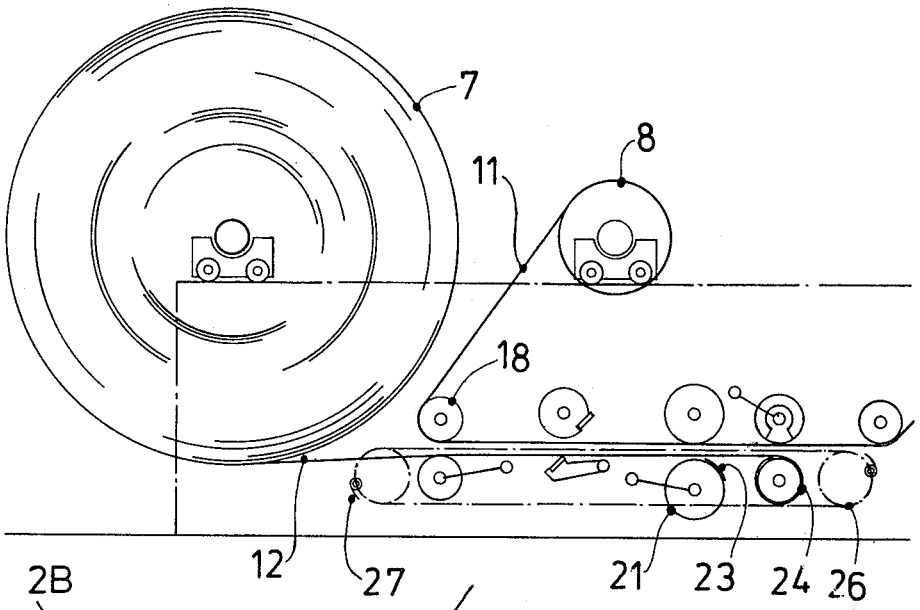

An account will now be given of the function of the system of the invention in more detail, using FIG. 2. FIG. *2a* is a view of a working stage shortly before reel change-over. For getting ready for such change-over, the start (or leading edge) of the web 12, which may be unrolled from the back reel 7, is pulled in along the web path of the web 11 unrolled from front reel 8 and going to transverse cuttter 3, into the working stations of the system of the invention so that at the working stations of the system, we will have a double web made up of two single webs in the form of the old web 11, which is being unrolled from the front reel 8 and is moving to the transverse cutter 3, and a further web 12, named the new web, taken from the back, so far unused reel 7. The start (or leading edge) of the new web 12 will be seen in FIG. *2a* to have been positioned on its winding-up roll 24. In the working example pictured, for this purpose, simply one or two turns have been rolled up. Because the new reel 7 is, in all cases, placed on the back end, freely able to be got at, of the reel support 2, it is best for the new web 12, being taken from this reel to be pulled through under the old web 11, running to transverse cutter 3. For this reason, it is best for the lower winding up roll 24 of the pulling parts 16 to be used with new web 12. The old web 11, now coming to an end, and being taken from the pushed-forward reel 8, becomes placed round the top guide roll 18 when the reels are moved. So it is best for the guide roll 18 to be stationary. For pulling in the new web 12, it is best to make use of a pulling-in unit, generally numbered 26, which has at least one rod 27, which, in the example pictured, has grippers, and which is supported on side chains, the start (for leading edge) of the new web 12 being able to be fixed to rod 27. Before or after the pulling-in of the new web 12, joiner roll 21 is given its adhesive strip 23 and, for this purpose, joiner roll 21 may have a segment which may be taken from it and put back again.

The winding-up roll 24, designed for use with the new web 12, is joined up, by way of a clutch, not detailed in the figure, with a driving element, which, as well, is not detailed. By working the said clutch, the winding-up roll 24 and, for this reason, the reel 7 as well, are turned, the clutch being best designed as a slipping clutch for smoothly starting up operation of the apparatus. At the same time as the winding-up roll 24 is run up to speed, the advancing unit, the cutting station and the joining station may be run up to the necessary speeds of operation. When the full speeds of running have been got to, the advancing speed of the new web 12 will be exactly the same as the forward speed of the old web 11. In this stage, the system is kept going till the outer, damaged, or for some other reason useless, layers of reel 7 have been stripped off and taken up by the winding-up roll 24.

Figure 2B:
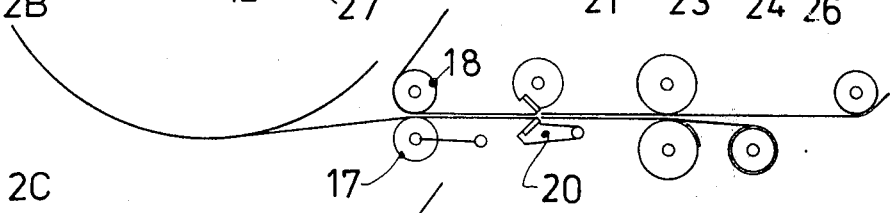

For starting reel change-over, the swinging knife 20 of the cutting station 14 is moved into the working position of FIG. 2*b* so that the double web, made up of part of the old web 11 and of the new web 12, is cut through. At least at the same time or, better still beforehand, the swingingly supported guide roll 17 is run up against the stationarily bearinged guide roll 18 so that, even after the cutting operation has been undertaken, the double web will be kept moving forwards, in all cases, and further unwinding from reels 7 and 8 takes place. The timing of joining station 15 is such that adhesive strip 23 is moved through the space or nip between joiner roll 21 and opposite roll 22 at the same time as the cut or joint goes therebetween. Operation of joining station 15 is timed and produced by moving the swinging joiner roll 21 against the stationary opposite roll 22. The swinging motions of knife 20, guide roll 17 and joiner roll 21 are best joined up together so that there is generally automatic operation.

Figure 2C:
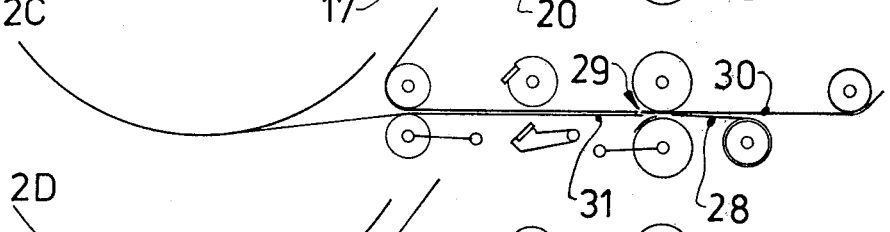
Figure 2D:
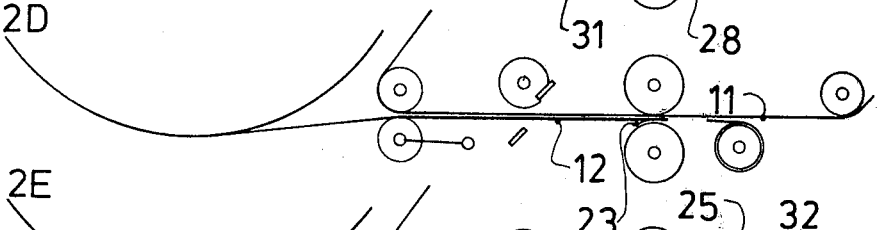

Winding-up roll 24, placed for use with new web 12, is best turned at a somewhat higher speed after the cut has been produced. With the help of the slipping clutch noted supra, this may readily be effected. This makes certain that the free back (or trailing) end 28, produced on cutting, of new web 12 is pulled clear of the position of cutting 29 and goes past the joining station 15 before the same. This is specially clearly marked in FIG. 2*c*. When the cut 29 goes through joining station 15, the joiner roll 21 will have the effect of rolling adhesive strip (or joining strip) 23 half on the free back end 30, produced on cutting, of old web 11 and half on the free front end 31, produced on said cutting operation, of new web 12, this producing the desired joint between old web 11 and new web 12. FIG. 2*d* is based on this stage. Now stock supplied to transverse cutter 3 is taken from reel 7 by unwinding therefrom.

Figure 2E:
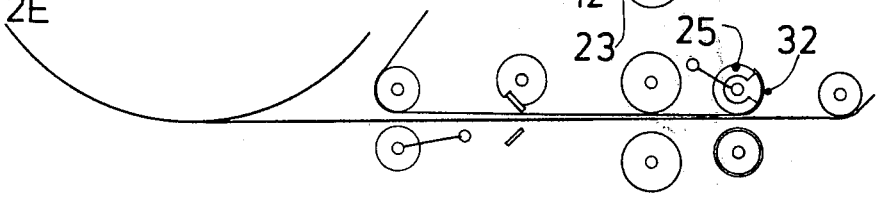

The free, leading end 32, produced on cutting of the back waste run of old web 11 is, after going through joining station 15, taken up by the winding-up roll 25, placed here and which may be best designed as a suction roll, which is simply put into operation by swinging so that the front end 32 of the back waste run of the old web 11, as may readily be seen from FIG. 2*e*, is placed round roll 25, winding-up thereof taking place till the complete system and, for this reason, furthermore the old, used up reel 8 has been stopped. Winding-up roll 25 has, for this reason, the function of a switch, as in a railroad, for pulling off the waste run, coming after the cut, of old web 11. Winding-up roll 24, used with the new web 12 is, on the other hand, used for taking up the waste run coming in front of the cut. Winding-up rolls 24 and 25 are best made so that they may be taken out of the system for readily clearing the waste web stock from them after winding up. After the apparatus has been stopped, the used up reel 8 is taken off, its core rod then being on hand for use with a new reel, after the old reel core tube has been taken off it.

Between transverse cutter 3 and the working stations of the system of the invention, it is possible to make use here of a paper store, generally numbered 33, and having a timing effect, in which the paper web, on its way to transverse cutter, is guided in loops between fixed-position and moving rolls 34 and 35. In the working example pictured, the moving idler rolls 35 of the paper store 33 may be fixed or adjusted at any desired level. This makes it possible for the web length between transverse cutter 2 and cutting station 14 to undergo adjustment to one exact multiple of the paper size (format) length. This is useful, because the cut in transverse cutter 3 is made at quite the same position as in cutting station 14 so that the adhesive strip 23 is cut truly in the middle so that after cutting in transverse cutter 3, the one half of adhesive strip 23 is placed on the back or trailing edge of a sheet and the other half on the front or leading edge of the next sheet. Because the sheets 5 are then transported away in a direction normal to the plane of the drawing, these adhesive strip halves will be on the left hand and on the right hand edges of the sheet in question. Because, for example, on printing sheets a free edge is generally kept unprinted, the adhesive strip may have no undesired effects whatsoever. Adjustment of the moving idler rolls 25 of paper store 33 is best undertaken before reel change-over.

I claim:

1. In an automatic reel change system, for use on processing a paper web taken from a reel and feeding it to a transverse cutter, of the type having a reel support for at least two reels from which, on reel changing, a two-ply double web may be taken composed of a new web and an old web, a cutting station disposed adjacent to the path of the double web for performing a cutting operation on said double web, said cutting station having means for cutting said double web along a cut line, thereby cutting said old web so as to produce a waste run disposed rearwardly of the cut line, relative to the direction of web travel, and separated therefrom and disposed forwardly of said cut line, a new trailing end of said old web, and thereby cutting said new web so as to produce a waste run disposed forwardly of the cut line, relative to the direction of web travel, and separated therefrom and disposed rearwardly of said cut line, a new leading end of the new web, a joining station disposed after said cutting station in the direction of the web travel for performing a joining operation which is timed for operation after said cutting operation, said joining station having means for joining said trailing end of the old web with said leading end of said new web by means of an adhesive strip overlapping and forming a joint between said new ends, and an advancing unit through which said double web runs which is disposed before said cutting station, relative to the direction of web travel, for performing an advancing operation on said double web, which is timed for operation at least between said cutting and joining operations, the improvement comprising:

two winding-up rolls, one for accomodating a plurality of turns of said waste run of said new web, and the other one for accomodating a plurality of turns of said waste run of said old web, said winding-up rolls being disposed after said joining station and being independently timed for operation, at least said winding-up roll for said waste run of said old web being a suction roll which is pivotably supported for movement between an inoperative and an operative position, in the latter of which it is positioned to wind up said waste run of said old web, and wherein said winding-up roll for winding up said waste run of said new web is a driven roll operable at a speed slightly greater than the normal web speed.

2. The system according to claim 1, wherein said joining station includes a joiner roll which has an axis which is parallel to the cut line produced in said cutting station at which supports an adhesive joining strip running over the full web breadth and a cooperating, stationarily bearinged counter roll disposed opposite thereto.

3. The system according to claim 1, wherein said cutting station has two knives disposed crosswise relative to the direction of web travel, one of which is supported by a fixed, rotatable roll and the other which is pivotably-supported.

4. The system according to claim 1, wherein said advancing unit has two guide rolls, at least one of which is driven and at least one of which is adjustably supported for movement towards and away from the other roll.

5. The system according to claim 1, wherein said old web and said new web are supported by said reel support such that they are fed to said advancing unit with said new web being guided and disposed under said old web.

6. The system according to claim 1, additionally including a web pulling-in unit for pulling said new web through said cutting and joining stations prior to said cutting and joining operations.

7. The system according to claim 1, additionally including fixedly adjustable storage means for adjusting the length of said web between said transverse cutter and said cutting station to exactly one multiple of the format or sheet length being processed.

8. The system according to claim 7, wherein said storing means comprises fixedly adjustable idler rolls which may be moved and then fixed in position after adjustment.

* * * * *